United States Patent [19]

Inoue

[11] Patent Number: 4,564,832

[45] Date of Patent: Jan. 14, 1986

[54] MEMBRANE KEYBOARD HAVING KEY CLOSURE RETENTION

[75] Inventor: Kazuo Inoue, Toride, Japan

[73] Assignee: Nippon Mektron, Ltd., Japan

[21] Appl. No.: 480,915

[22] Filed: Mar. 31, 1983

[30] Foreign Application Priority Data

Mar. 31, 1982 [JP] Japan ..... 57-53157

[51] Int. Cl.[4] ..... G08C 9/00

[52] U.S. Cl. ..... 340/365 R; 340/365 L; 400/276; 400/479.2

[58] Field of Search ..... 200/5 A; 340/365 R, 340/365 L; 400/276, 479.1, 479.2; 335/207

[56] References Cited

U.S. PATENT DOCUMENTS 3,588,766 6/1971 Baermann ..... 340/365 L
3,680,026 7/1972 Masuda ..... 340/365 L
4,028,696 6/1977 Madland ..... 340/365 L
4,420,663 12/1983 Larson ..... 200/5 A

OTHER PUBLICATIONS

Bantz, et al., "Keyboard Device for Upper and Lower Case Keying Without Shifting," IBM Technical Disclosure, vol. 21, No. 9, Feb. 1979.

Fox, "Dual-Force Automatic Rekeying," IBM Technical Disclosure, vol. 17, No. 1, Jun. 1974.

*Primary Examiner*—John W. Caldwell, Sr.
*Assistant Examiner*—Michael F. Heim
*Attorney, Agent, or Firm*—Fishman & Dionne

[57] ABSTRACT

A membrane panel keyboard is presented having magnetic material in one contact element and magnetic field generating means to achieve self-retention or key closure retention when a key is actuated.

13 Claims, 7 Drawing Figures

MEMBRANE KEYBOARD HAVING KEY CLOSURE RETENTION

BACKGROUND OF THE INVENTION

This invention relates to the field of membrane or panel keyboards. More particularly, this invention relates to new and improved membrane or panel keyboards having self-retention (i.e., key closure retention) structure and function.

A simple membrane or panel keyboard switch assembly includes a base sheet with electrically conductive contact elements thereon, an upper switch sheet with movable contact elements in a pattern corresponding to the base contact elements, and an insulating spacer sheet therebetween. An electrical connection (i.e. switch closure) is made by actuating a movable contact element and bringing it into physical contact with the corresponding base contact element. Depending upon the purpose and application of an instrument equipped with a panel keyboard, it is sometimes necessary to maintain a circuit closed (i.e. in a conducting state), either for a limited period or continuously, once contact has been made between the contact elements. In a simple panel keyboard switch, this can only be accomplished by continuously pushing the movable contact point pattern against the fixed contact point.

In the prior art, a separately provided special electric circuit has been used in order to achieve this condition, i.e., the self-retention or circuit closure condition. Such a circuit, however, is complex with many parts. As a result, the prior art self-retention or circuit closure or lock on devices incorporated into panel keyboards are both expensive and hinder the design freedom of such devices.

SUMMARY OF THE INVENTION

The above discussed and other problems of the prior art are overcome or alleviated by the panel membrane keyboard of the present invention. In accordance with the present invention, a novel self-retention function (or circuit closure or lock on) is provided in the switch mechanism of a simple membrane or panel keyboard. Thus, unlike the previously discussed prior art, in the present invention a self-retention condition can exist without complex electric circuit for self-retention.

The present invention is comprised of a simple membrane switch structure wherein the movable contact point pattern is made of a magnetic material and an electromagnetic coil is provided on the fixed contact pattern base or support sheet to generate a magnetic attractive force to maintain physical and electrical contact between the electrical switch contacts on the base and switch sheets. This magnetic force, in turn, results in continuous contact (self-retention or circuit closure) between the two contact patterns for a desired length of time. Break-up of such self-retention condition (i.e. opening of the circuit) is accomplished by a self-retention break-up switch whereby the electrical current through the circuit is shut off and the magnetic field is dissipated from the electromagnetic coil.

The panel keyboard with novel self-retention or circuit closure means disclosed in the present invention is small and compact, has relatively few parts and is inexpensive to manufacture.

The above-discussed and other advantages of the present invention will be apparent to and understood by those skilled in the art from the following detailed description and drawings.

BRIEF DESCRIPTION OF THE DRAWINGS

Referring now to the drawings, wherein like elements are numbered alike in the several figures.

DESCRIPTION OF THE PREFERRED EMBODIMENT

Figure 1:
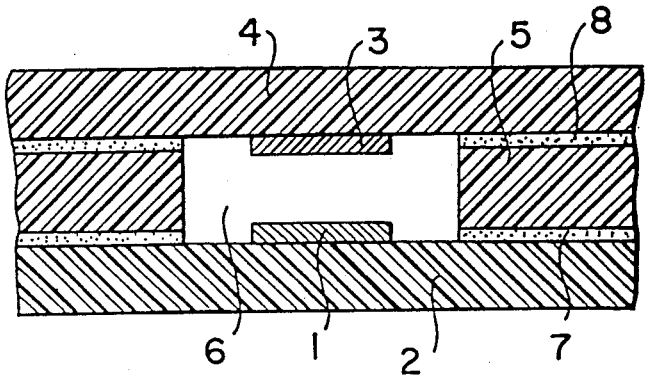
FIG. 1 PRIOR ART
FIG. 1 is a cross-sectional elevation view of a conventional panel keyboard in accordance with the prior art.

Referring first to FIG. 1, a membrane or panel keyboard in accordance with the prior art is shown. A flexible or rigid base sheet 2, typically of an insulating synthetic material having a desired fixed circuit pattern of contact elements 1 formed thereon is shown. The circuit pattern may be formed by any conventional printed circuit or similar technique. A resilient and flexible switch sheet 4 has a pattern of movable contact elements 3 which corresponds to the pattern of fixed base elements 1 is positioned above the base sheet 2 across a switch motion cavity 6. Base sheet 2 and contact sheet 4 are separated by an insulating spacer 5 having openings or switch cavities 6. Adhesive layers 7 and 8 bond the sheets together.

When a switch motion is initiated or actuated by manual force in a panel keyboard such as shown in FIG. 1, the movable contact element 3 is depressed and physically brought into contact with the fixed contact point 1 thereby closing an electrical switch. Should the keyboard operator wish to maintain contact, the movable contact point must be continuously pushed down; or separate circuit retention circuitry must be provided. The manual method of self-retention is highly undesirable and burdensome to the keyboard operator; the separate circuit retention circuitry is expensive.

Figure 2:
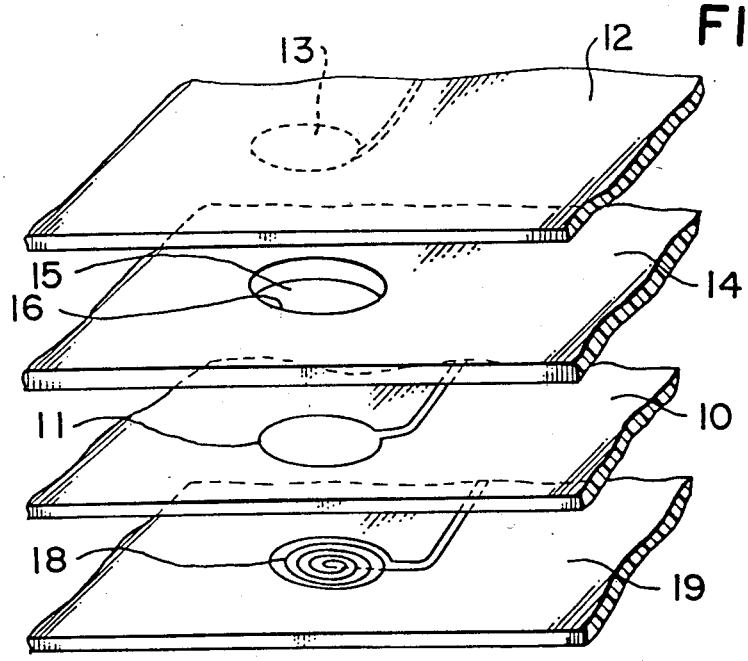
FIG. 2 is an exploded perspective view of a panel keyboard with self-retention or circuit closure elements in accordance with the present invention.
Figure 3:
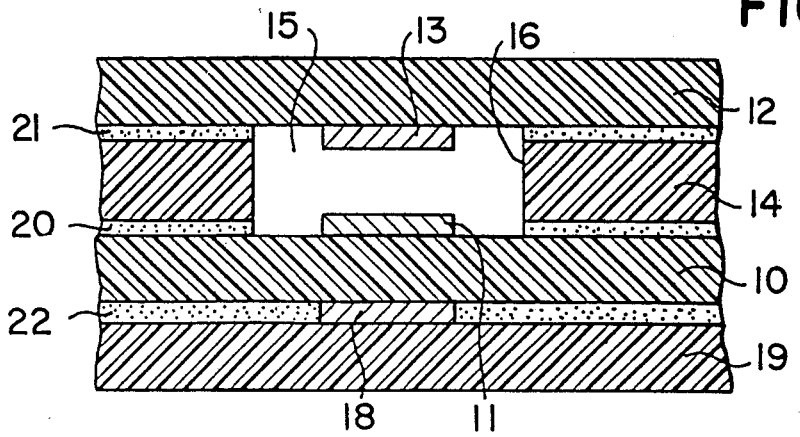
FIG. 3 is a cross-sectional elevation view of the panel keyboard of FIG. 2, shown in its assembled condition.

Referring now to a joint consideration of FIGS. 2 and 3, a panel keyboard with built in self-retention or circuit closure means in accordance with the present invention is shown. The panel keyboard shown in FIGS. 2 and 3 has the same general components as in the prior art structure but with the addition of an electromagnetic circuit to provide a self-retention or circuit closure function.

A base sheet 10, has a pattern of fixed contact elements 11 made of an electro-conductive paint is formed thereon. A resilient and flexible switch sheet 12 has a pattern of movable contact elements 13 corresponding to the fixed contact elements 11 is made of an electro-conductive paint which has magnetic properties whereby magnetic poles are formed in the direction of the switch movements; i.e., in a direction perpendicular to the plane of the fixed contact elements. A spacer film or sheet 14 is positioned between the base sheet 10 and the switch sheet 12. This spacer sheet 14 has an array of holes 16 provided for the purpose of forming an array of switch motion cavities 15. A printed circuit coil 18, which functions as an electromagnetic coil, is positioned on the lower side of base sheet 10 directly under fixed contact 11 and in alignment with the movable contact elements 13. This coil is made of an electro-conductive metal such as copper or aluminum, or an electro-conductive paint and is supported on a coil support sheet 19. The support sheet 19 may (as with the other sheets in the array) be made from a polyester polyimide or polyamide resin or any other suitable synthetic resin. The electro-magnetic coil 18 may be connected in series with the fixed contact element 11 and the movable contact element 13; or coil 18 may be connected to an electric power source by way of a separately provided switch (not shown). The base sheet 10 and switch sheet 12 are bonded to the respective surfaces of the spacer sheet 14 by adhesive 21 and adhesive 20. Adhesive 22 provides bonding of the coil support sheet 19 to the lower surface of the base sheet 10. Any conventional polymeric adhesive may be used in the present invention.

Of course, while only one each of the elements 11, 13 and 18 are shown, it will be understood that there are a plurality of such elements in a desired array, with there being one coil 18 for each pair of switch elements 11 and 13.

In the panel keyboard having the above described structure, the previously discussed desirable feature of self-retention or circuit closure retention is achieved. When the movable contact element 13 is actuated by pushing down on the switch sheet 12 so that it is physically pressed against the fixed contact element 11, the printed circuit coil 18 is electrically connected and activated with a current flow. Thus, a magnetic field is generated resulting in attractive attachment of the movable contact element 13 to the fixed contact element 11. Thus, a condition is maintained wherein the movable contact element 13 is kept in contact with the fixed contact element 11 even after the operator removes his finger from the switch sheet 12. Note that the printed circuit coil 18 may be electrically connected either by (1) the coil 18 being connected in series with the fixed contact element 11 and the movable contact element 13 or by (2) simultaneously actuating the switch sheet and also closing a separately provided self-retention switch connected to the coil.

Break-up or termination of the self-retention condition is accomplished by interruption of the current through the electrical circuit (consisting of the fixed contact element 11, the movable contact element 13 and the coil 18) by use of a self-retention break-up or termination switch (not shown) (in the case where the two contact elements 11 and 13 and the print coil 18 are connected in series) or by opening the aforementioned separate self-retention switch whereby the current through the coil is shut off. In either case, the magnetic field is dissipated from coil 18 and the movable contact element 13 springs back due to the resilient force of the switch sheet 12 thereby effecting physical separation and electrical disconnection between the two contact elements.

Figure 4:
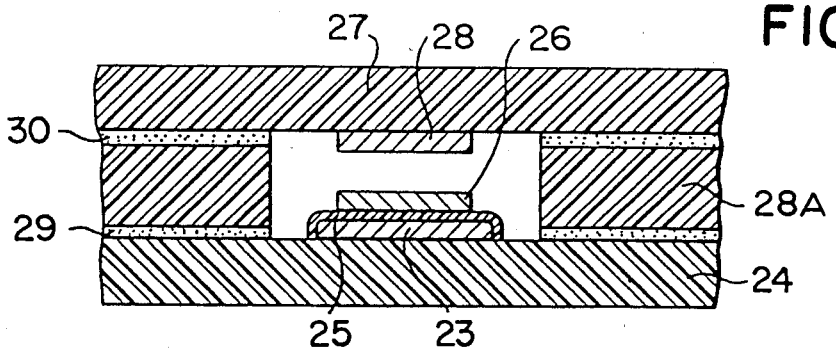
FIG. 4 is a cross-sectional elevation view, similar to FIG. 3, of another embodiment of a panel keyboard with self-retention elements in accordance with the present invention.

An alternative embodiment of the present invention is shown in FIG. 4. This embodiment is essentially similar to the same as the embodiment of FIGS. 2 and 3, but has fewer parts and therefore is more compact in size. In essence, the coil support sheet 19 of FIG. 3 has been removed in FIG. 4 so that the printed circuit coils 23 are bonded to the top surface of base member 24. An insulating layer 25 is then bonded to the upper surface of each coil 23, and a fixed contact element 26 is positioned on the upper surface of each insulating layer 25. Similary, as in FIG. 3, a switch sheet 27 having movable contact elements 28 thereon (with magnetic material on elements 13) is positioned above base sheet 24 with a spacer sheet 28A therebetween. The spacer sheet is adhesively fixed to the base sheet by adhesive 29 and to the switch sheet by adhesive 30.

As mentioned, the embodiment of FIG. 4 permits both the fixed contact element 26 and the coil 23 to be on the same side of base sheet 24. This can be advantageous in that the number of parts and cost of labor can be lessened as compared to the FIG. 3 embodiment of the present invention.

Figure 5:
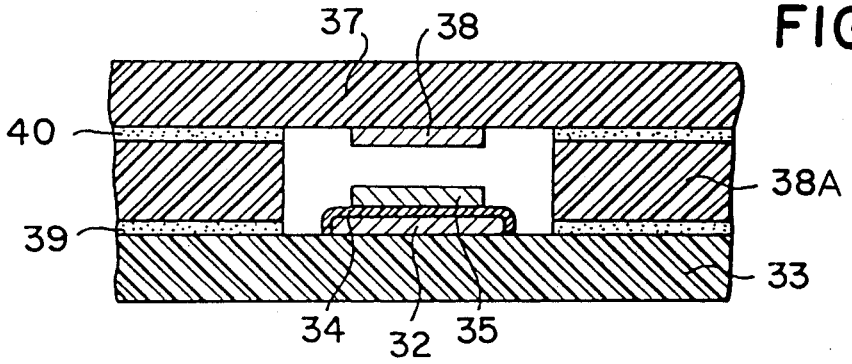
FIG. 5 is a cross-sectional elevation view similar to FIG. 4, of another embodiment of a panel keyboard with self-retention elements in accordance with the present invention.

Another alternative embodiment shown in FIG. 5 is designed so that an enhanced attractive magnetic force may be obtained at low energy levels. The embodiment in FIG. 5 has an essentially identical structure as in FIG. 4 except that the fixed contact elements 35 on insulator 34 are also made of an electro-conductive paint containing the magnetic material whereby a magnetic field is formed in the same direction as the field of the coil 32. As in FIG. 4, the other elements in this embodiment include a base sheet 33, a switch sheet 37 having a movable contact elements 38 thereon (with magnetic material on elements 13), the base and switch being sheets separated by a spacer sheet 38A adhesively fixed to the respective sides of the base and switch sheets by adhesives 39 and 40.

In the embodiment of FIG. 5, the magnetic field generated by the coil 32 is added to the magnetic field generated by fixed contact element 35 thereby providing a much stronger magnetic force than disclosed in the previously described embodiments. Thus, for a given amount of current, the embodiment of FIG. 5 will exert a stronger magnetic force upon the movable contact elements. This larger force provides a self-retention or circuit closure retention function which is very stable against vibration, impact and other disruptive occurances. Even more importantly, when the embodiment of the present invention shown in FIG. 5 is used in an environment free from disruptive forces, the magnitude of current fed to the coil 32 can be reduced in proportion to the amount of magnetic force contributed from the fixed point contact element 35, and can therefore achieve a reduced energy consumption.

In all of the aforementioned embodiments of the present invention, the break-up or termination of the self-retention function is accomplished by manipulating a switch provided at a location separate from the operational portion of the movable contact elements. However, for certain applications, it is often desirable to break as well as make the self-retention function at the operational portion of the keyboard. The alternative embodiments of FIGS. 6 and 7 allow for this type of panel keyboard operation.

Figure 6:
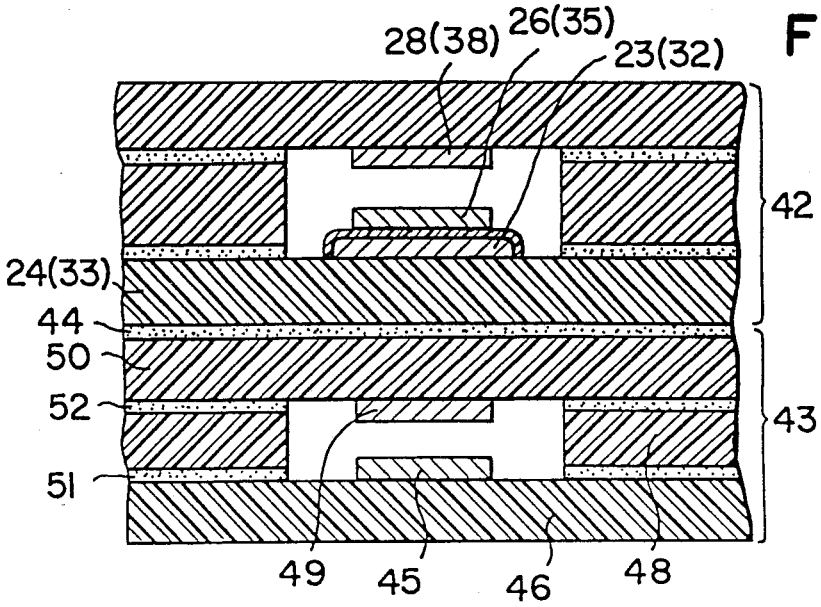
FIG. 6 is a cross-sectional elevation view of still another embodiment of a panel keyboard with self-retention, similar to FIG. 4, and incorporating additional structure for circuit opening in accordance with the present invention.

In FIG. 6, a sub-keyboard switch 43 for the break-up or termination of self-retention is attached to the lower surface of panel keyboard 42 by way of an adhesive material 44. Panel keyboard 42 has the same structure as shown in FIG. 4 or FIG. 5. The sub-keyboard 43 is a laminated structure having in sequence towards the panel keyboard 42, a base 46 having a pattern of fixed contact elements 45 thereon, a spacer 48 and a switch sheet 50 having a pattern of movable contact elements 49. The spacer 48 is adhesively bonded between sheets 46 and 50 by adhesives 51 and 52. The two contact elements 45 and 49 at each key location of the sub-keyboard are arranged in alignment with a pair of contact elements 25 (35) and 28 (38) of the panel keyboard 42.

When the panel keyboard operator lightly presses a movable contact element 28 (38) of the panel keyboard 42, the movable contact 28 (38) will physically and electrically contact a fixed contact element 26 (35), and a current will flow through the print coil 23 (32) thereby resulting in self-retention even though the operator removes the actuating force. Thereafter, when the cessation of the self-retention function is desired, the operator merely exerts a somewhat greater pressure on the movable contact 28 (38). This causes the base sheet 24 (33) of the panel keyboard 42 and the switch sheet 50 of the sub-keyboard 43 to flex downwardly whereby the movable contact element 49 comes into physical and electrical contact with the fixed contact element 45. This contact activates a break-up circuit whereby the current through the coil 23 (32) and the corresponding self-retention condition is terminated.

As mentioned previously, the embodiment of FIG. 6 provides the operator with a convenient means wherein both the self-retention and the cancellation thereof can be accomplished at the same operational portion.

Figure 7:
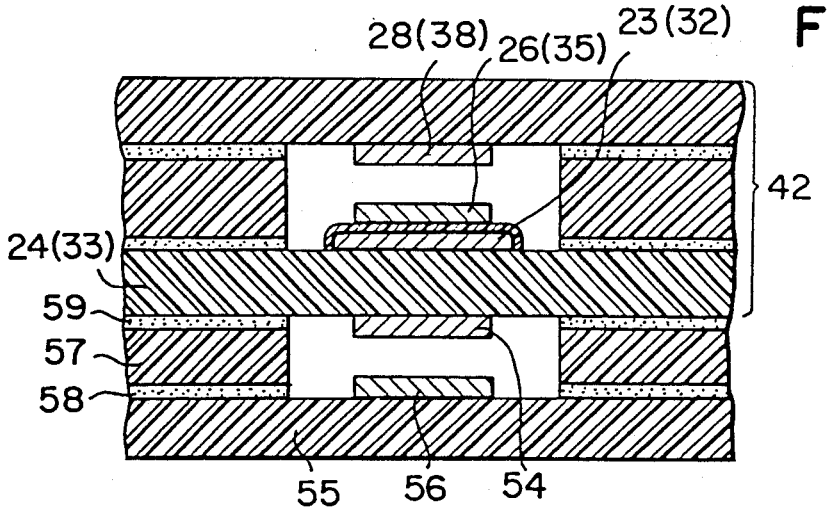
FIG. 7 is a cross-sectional elevation view, similar to FIG. 6, of another embodiment of a panel keyboard with self-retention and incorporating circuit opening structure in accordance with the present invention.

The embodiment of FIG. 7 is very similar to the one shown in FIG. 6, except that the base sheet 24 (33) of the panel keyboard 42 is itself utilized as the switch sheet of the sub-keyboard. A pattern of movable contact elements 54 is provided on the lower surface of the switch sheet 24 (33). Other elements of this embodiment include a base sheet 55 having a pattern of fixed contact elements 56 thereon, and a spacer 57 located between the base sheet 55 and switch sheet 24 (33) and adhesively fixed by adhesives 58 and 59.

By using one membrane sheet for two purposes (i.e., base sheet 24 (33) of the panel keyboard 42 is utilized as the switch sheet of the sub-keyboard), the embodiment of FIG. 7 has fewer parts, requires less manufacturing labor, is more economical to produce, and has a thinner, more compact structure than the embodiment of FIG. 6.

Thus, the present invention, as described above in its several embodiments, provides a self-retention or circuit closure retention structure at the operational portion of the keyboard. Hence, separate switches and electrical circuits for self-retention are unnecessary, resulting in a simplified, less expensive panel or membrane keyboard.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A keyboard comprising:

a first circuit sheet;

at least one first movable contact element on said first circuit sheet, said first contact element of said first sheet being electroconductive and having magnetic properties;

a second circuit sheet, said second circuit sheet having at least one second contact element on a first side of said second circuit sheet facing said first circuit sheet, said second contact element being electroconductive and having magnetic properties;

said first and second contact elements being aligned and normally being electrically disconnected, and being adapted to be brought into electrical contact by movement of said first contact element toward said second contact element;

electrical circuit means on said first side of said second circuit sheet and defining a coil for the generation of a magnetic field in alignment with said first and second contact elements to retain said first and second contact elements in physical and electrical contact;

insulation means over said electrical circuit means, said second contact element being supported on said insulation means;

retention termination means being associated with said circuit means defining a coil for terminating the generation of the magnetic field; and membrane switch means attached to said second circuit sheet on said second side thereof, said membrance switch means including;

a first sub-switch sheet adhesively fixed to the second side of said second circuit sheet;

said first sub-switch sheet having at least one electrically conductive movable contact element thereon;

a second sub-switch sheet having at least one electrically conductive fixed contact element thereon corresponding to and aligned with the movable contact element on said first sub-switch and with said circuit means defining a coil; and a spacer sheet separating and adhesively bonded to said first and second sub-switch sheets.

2. The keyboard of claim 1 wherein:

said circuit means defining a coil is supported on a third circuit sheet, said third circuit sheet being adjacent to the second side of said second circuit sheet.

3. The keyboard of claim 1 including:

aperatured spacer means between said first and second circuit sheets, said spacer means having an aperture in alignment with said first and second contact elements.

4. The keyboard of claim 3 wherein:

said circuit means defining a coil is supported on a third circuit sheet, said third circuit sheet being adjacent to the second side of said second circuit sheet.

5. The keyboard of claim 1 including:

aperatured spacer means between said first and second sub-switch sheets, said spacer means having an aperature in alignment with said contact elements on said first and second sub-switch sheets.

6. The keyboard of claim 1 wherein said membrane switch means includes:

said second circuit sheet having at least one electrically conductive movable contact element on said second side thereof; and a sub-switch sheet having at least one electrically conductive fixed contact element thereon corresponding to and aligned with the movable contact element on said second side of said second circuit sheet and with said circuit defining a coil.

7. The keyboard of claim 6 including:

aperatured spacer means between said second circuit sheet and said sub-switch sheet, said spacer means having an aperature in alignment with the contact elements on said second circuit sheet and said sub-switch sheet.

8. A keyboard comprising:

a first circuit sheet;

at least one first movable contact element on said first circuit sheet, said first contact element of said first sheet being electroconductive and having magnetic properties;

a second circuit sheet, said second circuit sheet having at least one second contact element on a first side of said second circuit sheet facing said first circuit sheet;

said first and second contact elements being aligned and normally being electrically disconnected, and being adapted to be brought into electrical contact by movement of said first contact element toward said second contact element;

electrical circuit means on said first side of said second circuit sheet and defining a coil for the generation of a magnetic field in alignment with said first and second contact elements to retain said first and second contact elements in physical and electrical contact;

retention termination means associated with said circuit means defining a coil for terminating the generation of the magnetic field; and insulation means over said circuit means, said second contact element being supported on said insulation means.

9. The keyboard of claim 8 including:

aperatured spacer means between said first and second circuit sheets, said spacer means having an aperture in alignment with said first and second contact elements.

10. The keyboard of claim 8 wherein said retention termination means includes:

membrane switch means attached to said second circuit sheet on said second side thereof.

11. The keyboard of claim 10 wherein said membrane switch means includes:

a first sub-switch sheet adhesively fixed to the second side of said second circuit sheet;

said first sub-switch sheet having at least one electrically conductive movable contact element thereon;

a second sub-switch sheet having at least one electrically conductive fixed contact element thereon corresponding to and aligned with the movable contact element on said first sub-switch and with said circuit means defining a coil; and a spacer sheet separating and adhesively bonded to said first and second sub-switch sheets.

12. The keyboard of claim 11 including:

aperatured spacer means between said first and second sub-switch sheets, said spacer means having an aperature in alignment with said contact elements on said first and second sub-switch sheets.

13. The keyboard of claim 8 wherein said membrane switch means includes:

said second circuit sheet having at least one electrically conductive movable contact element on said second side thereof; and a sub-switch sheet having at least one electrically conductive fixed contact element thereon corresponding to and aligned with the movable contact element on said second side of said second circuit sheet and with said circuit defining a coil.

* * * * *